US005765719A

United States Patent [19]

Upham et al.

[11] Patent Number: 5,765,719

[45] Date of Patent: Jun. 16, 1998

[54] ROLL DISPENSER AND RACK

[76] Inventors: Thomas W. Upham, 208 Scott Ave., Oshkosh, Wis. 54901; Brandon T. Dexter, 30 W. Snell Rd., Oshkosh, Wis. 54901; William J. Fritz, 3735 Glenkirk La., Oshkosh, Wis. 54904

[21] Appl. No.: 593,039

[22] Filed: Jan. 29, 1996

[51] Int. Cl.[6] ..... B65H 19/00

[52] U.S. Cl. ..... 221/196; 221/194; 221/266; 221/283; 242/560

[58] Field of Search ..... 242/560, 561; 221/196, 266, 283, 194, 195

[56] References Cited

U.S. PATENT DOCUMENTS

| | | | |
|---|---|---|---|
| 1,122,094 | 12/1914 | Ferris | 221/266 |
| 2,592,346 | 4/1952 | Scogin | 242/561 |
| 2,605,975 | 8/1952 | Page et al. | 242/561 |
| 3,580,651 | 5/1971 | Gauper | 242/560 |
| 3,865,295 | 2/1975 | Okamura | 242/560 |
| 4,298,138 | 11/1981 | Oden | 221/266 |
| 4,522,346 | 6/1985 | Jespersen | 242/561 |
| 4,564,148 | 1/1986 | Wentworth | 242/561 |
| 5,377,866 | 1/1995 | Watters | 221/196 |

FOREIGN PATENT DOCUMENTS

| | | | |
|---|---|---|---|
| 2239863 | 7/1991 | United Kingdom | 221/266 |

*Primary Examiner*—H. Grant Skaggs
*Attorney, Agent, or Firm*—R. Jonathan Peters

[57] ABSTRACT

The dispenser and rack for a roll of paper, plastic, or foil, which comprises a magazine for generally vertical disposition having an open bottom, and the inside dimensions of the magazine are sufficient to accommodate at least one roll. A paddle is mounted in the magazine, and a handle affixed to the paddle extends from an opening in the magazine and is free to be moved along the opening so as to actuate the paddle between a lower-most position and an upper-most position. The paddle is arranged so when in its lower-most position, it obstructs the open bottom so as to prevent a roll from dropping from the magazine; and when the paddle is actuated to its upper-most position, clearance is provided to allow a roll to drop from the magazine. A suitable bracket depends from the magazine beneath the open bottom, and the paddle allows one roll a time to drop from the magazine for engagement with the bracket, and is revolvedly mounted on the bracket, thereby exposing the roll for use.

14 Claims, 4 Drawing Sheets

ROLL DISPENSER AND RACK

FIELD OF THE INVENTION

This invention relates to a dispenser and rack for a roll of paper, plastic or foil, and more particularly to a dispenser and rack for storing one or more such rolls and dispensing one roll at a time for retention by a holder so as to be accessible for use as required.

BACKGROUND AND PRIOR ART

Various roll dispensers or magazines have been proposed or utilized for storing multiple rolls of a wound web, and for retaining a roll as required. These structures, however, tend to be cumbersome and/or somewhat complex. Moreover, these multiple roll dispensers typically require a roll holder having a spindle which is spring biased for retention.

Also, there is the type of structure shown in U.S. Pat. No. 5,377,866 comprising a dispenser rack for storing a plurality of rolls, which is mounted at an incline in a bathroom cabinet adjacent an opening in the cabinet wherethrough a roll may be dispensed.

This invention has therefore as its purpose to provide a dispenser and rack for storing one or more rolls of paper, plastic, or foil having an easy means for dispensing a roll onto a holder or rack for use.

It is another object of the invention to provide a roll dispenser and rack of the above type thereby obviating the need for a separate spindle seated in opposed recesses and having bias means deflectable for retention of a roll.

It is still another object of the invention to provide a roll dispenser and rack that is relatively simple in structure and operation, and is aesthetically pleasing.

SUMMARY OF THE INVENTION

In accordance with the present invention, there is provided a dispenser and rack for one or more rolls of paper, plastic, or foil, and is adaptable to be affixed to a supporting wall such as the wall of a bathroom. Broadly, the roll dispenser and rack comprises a magazine for generally vertical disposition having an open bottom, and means for dispensing one roll at a time from the magazine onto a retaining means or holding means positioned below the open bottom. The inside width and length of the magazine are sufficient to accommodate at least one, or where desired a plurality of rolls. A suitable holding member or retaining member, such as a resilient bracket or resilient tab, depends from the magazine beneath the open bottom, and hand actuating means allows one roll at a time to drop from the magazine for engagement with the retaining member thereby exposing the roll. That is, the roll is now accessible, and being revolvedly mounted on the retaining member, a web section may be removed from the roll as required.

More specifically, the dispenser and rack comprises a magazine for generally vertical disposition having an open bottom and preferably parallel side walls, and the inside dimensions of the magazine are sufficient to accommodate one or more rolls of paper, plastic, or foil wound on a suitable core. A paddle is mounted in the magazine, and a handle affixed to the paddle extends from an opening in the magazine, and is free to be moved so as to actuate the paddle between a lower-most position and an upper-most position. The paddle is arranged so when in its lower-most position, it obstructs the open bottom so as to prevent a roll from dropping from the magazine, and when actuated to its upper-most position, clearance is provided to allow a roll to drop from the magazine. A suitable retaining means or bracket depends from the magazine beneath the open bottom, and is adapted to engage the core of the roll. The paddle allows one roll at a time to drop from the magazine for engagement with the bracket and revolvedly mounted thereon, thereby exposing the roll for use.

In accordance with one embodiment of the invention, a horizontally disposed opening is provided in the front wall of the magazine. The side walls of the magazine, being parallel, have substantially opposed, parallel grooves which extend diagonally downwardly from the opening, and are adapted to receive the paddle for slidable movement in the grooves. A handle projecting from the opening can be moved to slide said paddle from the lower-most position to the upper-most position.

In another embodiment, the paddle has an arcuate blade generally conforming to the arc defined by the circumference of a roll, such as a toilet tissue roll, and a handle, affixed to the blade, projects outwardly from the opening in the magazine and is free to be moved along the opening so as to rotate the blade about its central, longitudinal axis. The paddle is arranged so when in its lower-most position the blade obstructs the open bottom to prevent a roll from dropping from the magazine, and when rotated provides clearance to allow a roll to drop from the magazine through said open bottom. Where desired, a vertically disposed opening is provided in the front wall above the bottom marginal edge for a distance no greater than about one-half the circumference of a roll, such as one-half the circumference of a toilet tissue roll, whereby the handle projecting from the opening can be moved upwardly so as to actuate the blade so as to be rotated about a roll in the magazine.

In a preferred embodiment of the invention, each of the opposed side walls of the magazine, which are substantially parallel, is provided with opposed openings, slits or slots of a generally semi-circular arc. The arc of each opening has a measurement or diameter approximately equal to the diameter of the roll, such as for a roll of toilet tissue, and each opening is disposed adjacent the bottom edge of the side wall so that the chord subtending the arc (the chord extending between the extremities of the arc) is substantially vertical. A paddle, comprising an arcuate blade and an integral handle, extends between the side walls and is mounted in the openings. The arc measurement of the blade is less than the arc measurement or circumference of each opening so as to be free to be rotated by hand through the arc of the openings and about its longitudinal axis. The paddle is arranged, when in its lower-most or neutral position, so that the blade obstructs the open bottom of the magazine to prevent the rolls from dropping out.

A suitable retaining means, e.g. bracket means, depends from each of the side walls beneath the open bottom of the magazine, and is adaptable to engage the core of a roll for revolvedly retaining the roll. The blade has a segmental arc measurement that is less than that of arc of the openings in the side walls such that when the paddle is rotated or pivoted by hand to the upper-most position there is a clearance to allow a roll to drop from the magazine through the open bottom and into engagement with the retaining means. It thus will be observed that the paddle in the neutral or lower-most position obstructs the open bottom of the magazine and the concave surface of the blade supports the lower-most roll stacked in the magazine; but when actuated or rotated about the arc of the openings so as to overlap the lower-most roll thereby permitting it to drop, the convex surface of the blade concomitantly restrains the adjacent roll above from dropping until the paddle is rotated or pivoted back to the neutral position thereby allowing that adjacent roll to drop into contact with the concave surface of the blade. Further, the trailing edge of the blade engages the roll that is dropping from the magazine and through the open bottom and exerts a slight pressure on the roll to force it into engagement with the retaining means.

In accordance with a preferred embodiment of the invention, the side walls extend downwardly past the open bottom of the magazine. In this manner, a roll suspended by the bracket means is partially obstructed from view thereby giving a more aesthetic appearance. In addition, the restraining means or bracket means is resilient and have an inside dimension (i.e., the distance between the restraining members) slightly less than the center axial length of the core of roll.

DETAILED DESCRIPTION OF THE INVENTION

Figure 3:
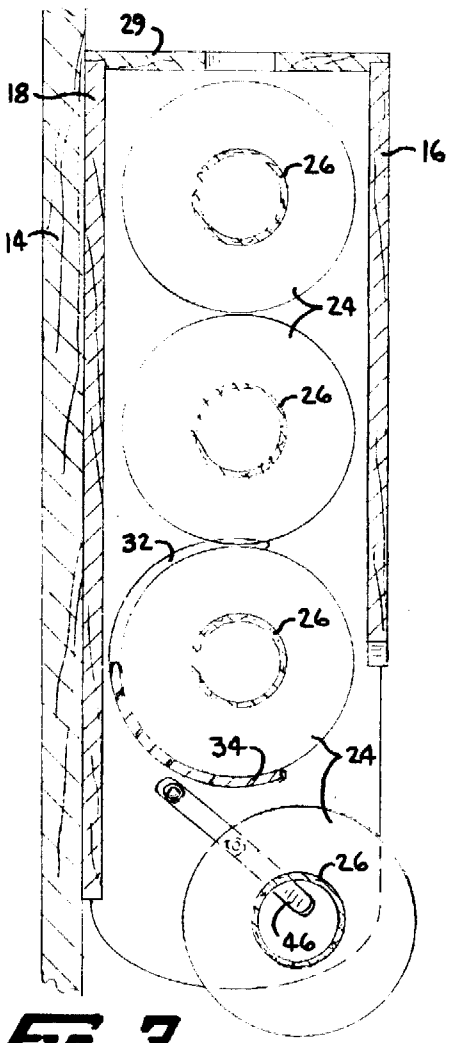
FIG. 3 is an elevational view in cross-section on line 3—3 of FIG. 1 showing a roll of tissue in place, and several rolls stacked in the magazine.
Figure 2:
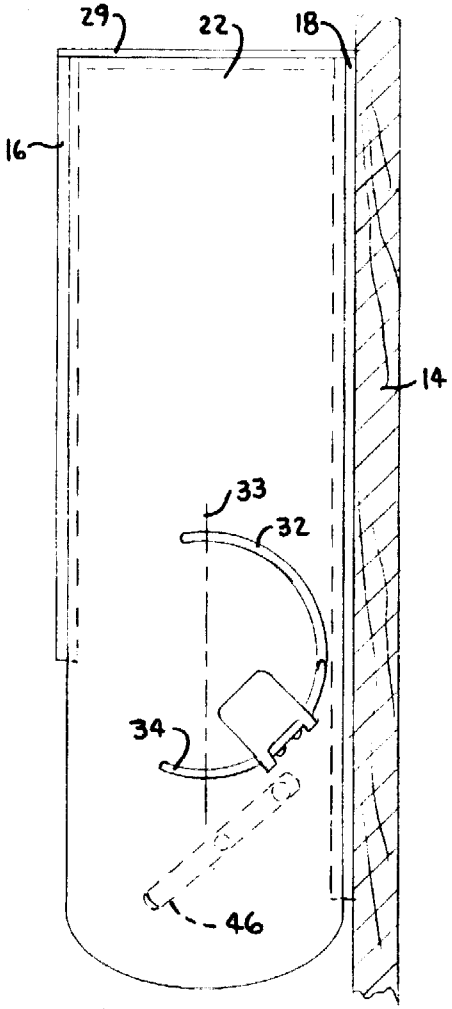
FIG. 2 is a side elevational view of the roll dispenser and rack of FIG. 1.
Figure 1:
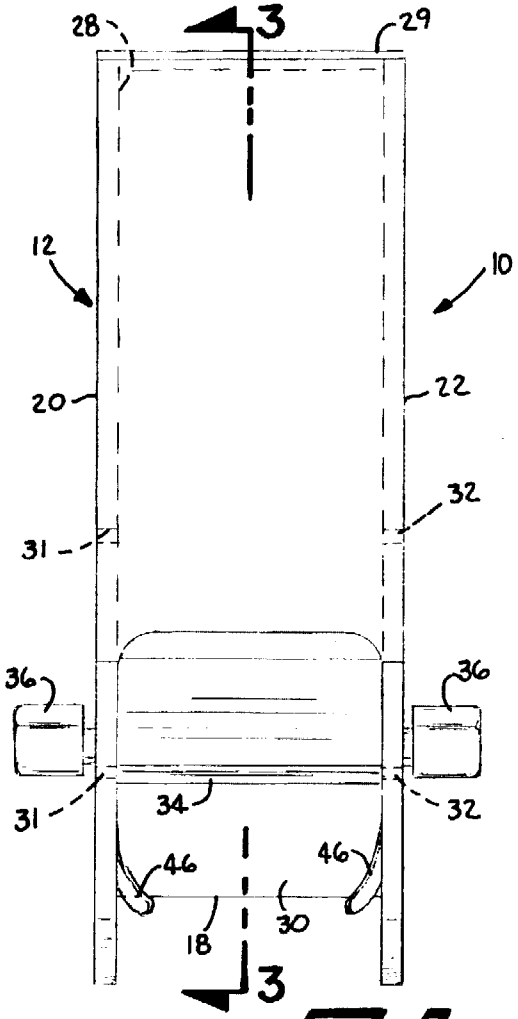
FIG. 1 is a front elevational view of a roll dispenser and rack of our invention.

Although the invention is described hereinbelow with particular reference to a dispenser and rack for a roll of toilet tissue, it should be understood that the invention is also applicable to rolls of other paper, plastic, and foil webs, such as rolls of paper towels. Referring to the drawings wherein like reference numerals designate similar parts throughout the various views, there is shown in FIGS. 1, 2 and 3 as an embodiment of the invention a roll dispenser and rack, indicated generally by the numeral 10. The dispenser and rack 10 may be constructed of any suitable material, including wood, metal, or plastic, or a combination of these materials. In the two views of FIGS. 1 and 2, no toilet tissue rolls are shown, but the device of our invention with rolls in place is shown in FIG. 3. The dispenser and rack 10 comprises an elongated magazine 12 of rectangular configuration for holding or storing rolls of tissue, and is affixed or attached to a wall or similar support 14 by conventional means such as screws or anchor bolts (not shown) for generally vertical disposition. The magazine has opposed front and back panels or walls, 16 and 18, respectively, and substantially planar, parallel side walls or panels 20 and 22. The inside width and length of the magazine should be sufficient to accommodate at least one roll of tissue 24 for storage (see FIG. 3), and preferably up to three rolls, but the size of the magazine can vary depending upon the particular needs of the end user. A roll of toilet tissue, comprising typical about 200–275 sheets wound on a cardboard core 26, has a diameter of about four inches and an axial length of about four and one-half inches, and typically is sold in the store to the customer in packages of two or four rolls per package. In this manner, the rolls taken from the package are inserted into the magazine 12, and one roll is dispensed or released from the magazine for retention by the holder, described hereinbelow in detail. Thus, the rolls 24 are arrayed in a vertical column within the magazine so that the central axes of the cores are horizontal and parallel to each other. Preferably, the front or back wall is cut-out as shown in FIG. 1 (front wall) so as to facilitate dropping of the roll onto the holder.

The magazine 12 is provided with an opening 28 at the top for inserting the rolls into the magazine, but where desired, the top may be provided with a cover 29, which may be hinged. Also, the magazine has opening 30 at the bottom, through which a roll is dropped onto a holding means, as described hereinbelow in detail.

Each of the opposed side walls 20 and 22 is provided with an opening or slit 31 and 32, respectively, approximating the arc of a semi-circle and having an inside diameter approximately equal to the diameter of a tissue roll. When the device is assembled, the openings 31 and 32 are in alignment, and the longitudinal, center axis of this semi-circle defined by the openings about corresponds with the center axis of the core 26 of the bottom-most roll 24 stored in the magazine 12. It should be understood, however, that the openings 31 and 32 may not be an full semi-circle, i.e., 180 degrees, but we have found that an arc ranging from about 90 degrees to 270 degrees, more preferably about 150–210 degrees, is generally satisfactory and operable for the device. As best seen in FIG. 1, each opening 31 and 32 is disposed adjacent, but spaced from, the bottom edge of the side walls 20 and 22, that is, adjacent the open bottom 30 of the magazine 12. Where desired, the side walls 20 and 22 may extend downwardly below the open bottom and below the front wall 16, which may be aesthetically more pleasing because the extended side walls partially conceal the roll from view but still leave it accessible for use. Further, each such opening 31 and 32 in the side walls 20 and 22, respectively, is disposed so that the chord 33 subtending the arc is substantially vertical; that is, the concavity of the arc opens to the front wall 16 of the magazine as shown in the drawings, although the concavity could be reversed and open to the back wall 18, and does not open to the top or bottom.

A paddle, platen, or the like, 34 is rotatably mounted in the openings 31 and 32 so as to extend between the side walls 20 and 22. The paddle comprises an arcuate blade 35 generally conforming to the arc defined by the arc of the openings 31 and 32 or the circumference of a toilet tissue roll. A handle 36 is affixed to the blade and projects outwardly from the opening so that the blade may be easily actuated by moving the handle. The circumference of the blade 35 is substantially less than the circumference of the openings 31 and 32 so as to be free to be pivoted or rotated about its longitudinal axis, as will be more apparent from the explanation below. We have found that a blade having a circumference about equal to one-half the circumference of the openings is particularly desirable; that is, the arcuate blade can have a cross-sectional annulus segment about one-half the segmental length of the semi-circular opening.

or a segment of about 90 degrees, but may be more or less. A segment that is too short will not sufficiently support a roll of tissue, and a segment that is too long will not allow for a roll of tissue to drop from the magazine for disposition on the holder.

The paddle 34, which also may be referred to as an arcuate platen, has a sufficient segmental length so as to obstruct the open bottom 30 of the magazine 12. Thus, when rolls of toilet paper are stored in the magazine 12, the blade 35 prevents the bottom-most roll from dropping through the magazine. However, when the paddle is pivoted or rotated upwardly in the slotted openings, there is a clearance thereby allowing the bottom-most roll to drop from the magazine.

At least one edge of the paddle 34 is provided with a laterally extending handle 36, so that the paddle can be hand actuated or rotated in the slots 31 and 32, but where desired, the handle may extend from both sides. Where desired, one or both of the horizontal marginal edges of the blade 35 may be tapered so as to allow for the edge to slide between the rolls and to push the roll into place. Thus, leading or upper marginal edge 44 is tapered as shown in the drawings, so that when the paddle 34 is rotated upwardly, the paddle can more easily slide between the rolls.

Retaining means or bracket 46 is positioned below the open bottom 30 of the magazine 12 for holding a roll of tissue. The bracket means depends downwardly from the side walls, and is adaptable to engage the core 26 of a toilet paper roll. The bracket is formed of a resilient material, such as a flexible or resilient flat metal spring anchored to the side wall and projected downwardly and inwardly with reference to the side walls so that the other end is free and biased in the direction of the roll. The projected portion or flared portion of the spring may be provided with a protrusion or boss (not shown) for gripping the paper core, or of a resilient plastic material having a gripping means such as a boss. Such a boss may be of a conical configuration having an arcuate apex, or may be a truncated cone, so that the roll is revolvedly retained by the bracket means. The inside dimension between brackets is less than the length of central, longitudinal axis of the core. Thus, the slight pressure created by the blade against a roll dropping from the magazine into place between the brackets deflects the brackets laterally and outwardly so as to accommodate the roll but still exerts sufficient pressure so as to retain the roll in place.

In operation of the dispenser, one or more rolls of toilet tissue is inserted into the magazine, the actual number depending upon the size of the magazine. As explained above, the paddle or platen 34 obstructs the open bottom of the magazine thereby preventing the rolls from dropping through. When it is necessary to dispense a roll from the magazine and onto the retaining bracket, the paddle is rotated or pivoted by hand so that the blade is rotated upwardly in the slots over the top of the bottom-most roll, and if two or more rolls are in the magazine, between the bottom-most roll and the next adjacent roll. If the leading edge of the blade is tapered, that is the horizontal marginal edge that is upper-most, it is easier for the blade to pass between the rolls. Rotation of the paddle causes a clearance or passageway at the bottom of the magazine, and therefore the bottom-most roll is free to drop but is caught by the retaining means or bracket. The paddle being in a raised position prevents the next roll from dropping through the magazine. The paddle is lowered, and the trailing edge (the lower, horizontal marginal edge) exerts a slight pressure on the roll held by the bracket so as to force the roll into engagement with the bracket. The paddle now being in the lowered position prevents the next roll or other rolls from dropping through the magazine. It will be observed that the roll held in place for use is readily accessible to the user, and is revolvedly retained by the bracket so that a sheet or sheets at a time may be removed from the roll along the perforations between the sheets.

Figure 6A:
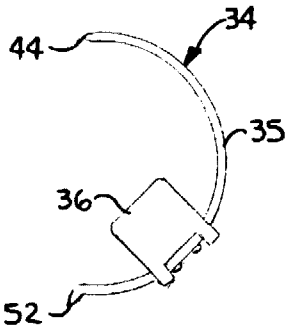
FIGS. 6A and 6B are a side elevational views of an alternative embodiments of a paddle.
Figure 6B:
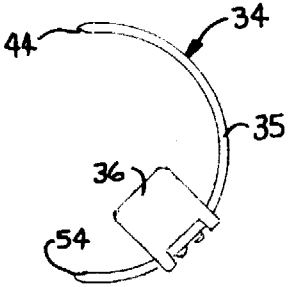
Figure 5:
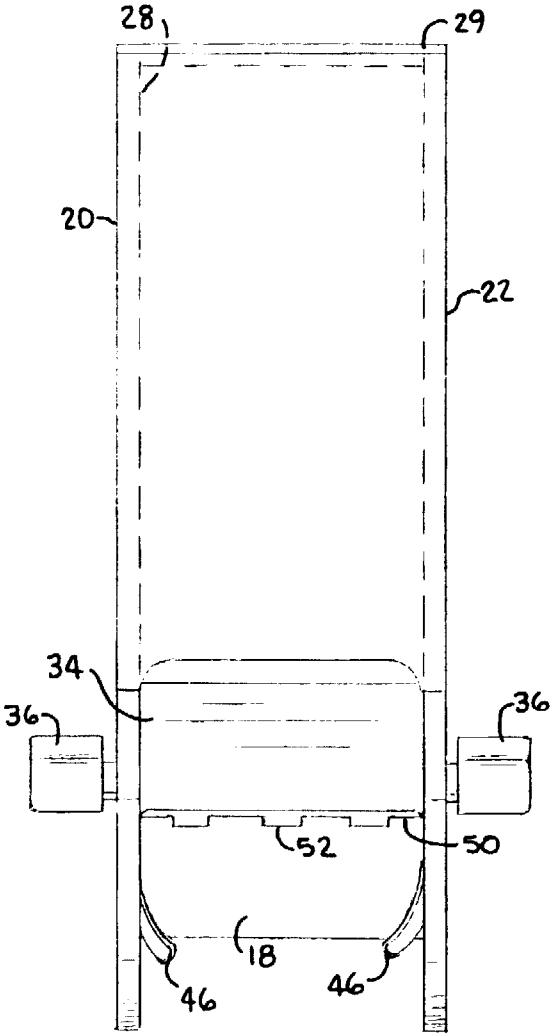
FIG. 5 shows an alternative embodiment of the invention utilizing a pronged blade.
Figure 4:
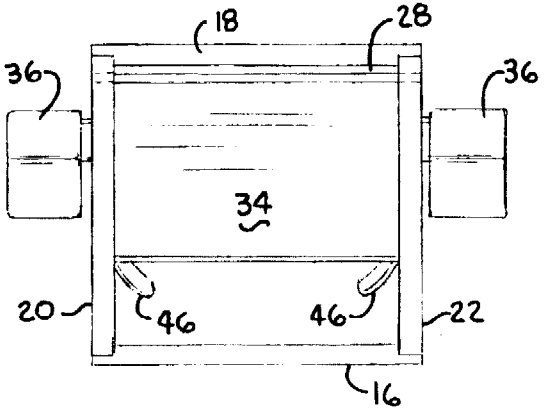
FIG. 4 is a plan view of the dispenser and rack.

In accordance with the alternative embodiment shown in FIGS. 5 and 6A, the trailing marginal edge 50 of the segmental paddle blade 35 is provided with a plurality of teeth or prongs 52. Where desired, the lower, horizontal edges of the blade 35, or of the teeth, may be tapered at 54 as shown in FIG. 6B. The peripheral teeth and/or the tapered marginal edges assist in transmitting pressure against the roll so as to force the roll into engagement with the bracket means.

Figure 7:
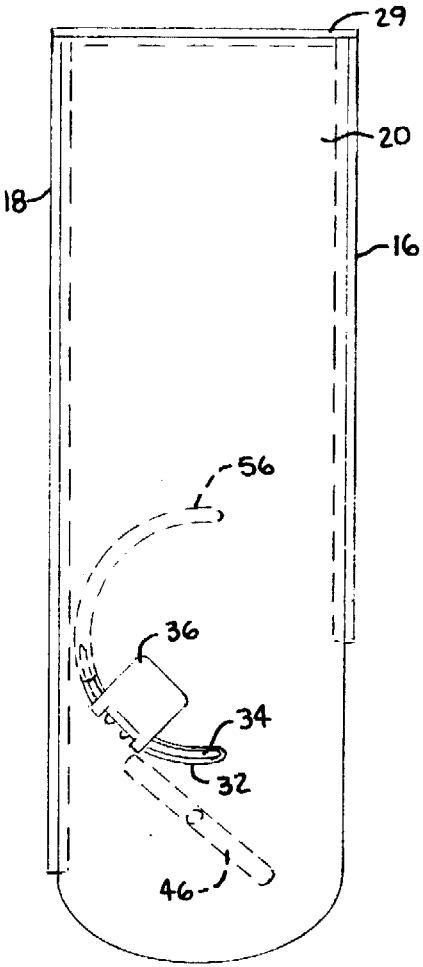
FIG. 7 is a side elevational view of alternative embodiment of the dispenser and rack of the present invention.

In accordance with the embodiment shown in FIG. 7, the openings 31 and 32 in each of the side walls 20 and 22, respectively, are approximately one-fourth the circumference of the tissue roll, or slightly less. However, the inside surface of each side wall is provided with an arcuate channel or track 56, the arc of which coincides with the arc of the openings 31 and 32. In this manner, the paddle 34 will travel or ride in the channel as it is pivoted from the lower-most position to the upper-most position.

Figure 9:
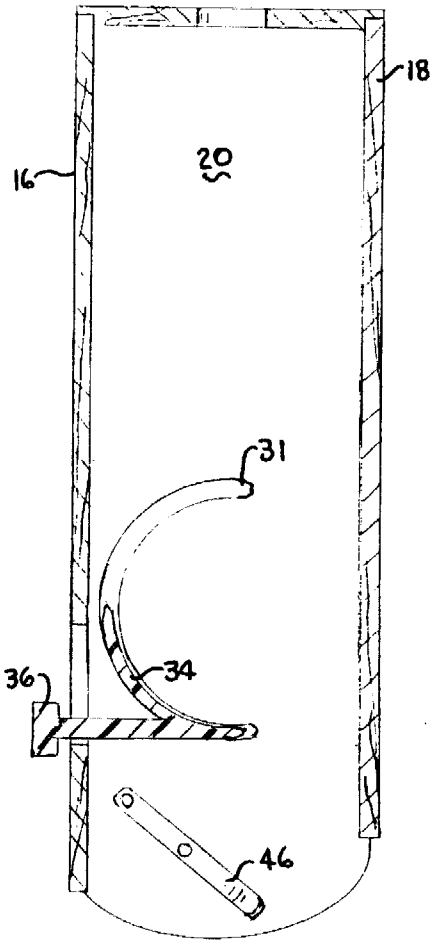
FIG. 9 is an elevational view in cross-section on line 9—9 of FIG. 8.
Figure 8:
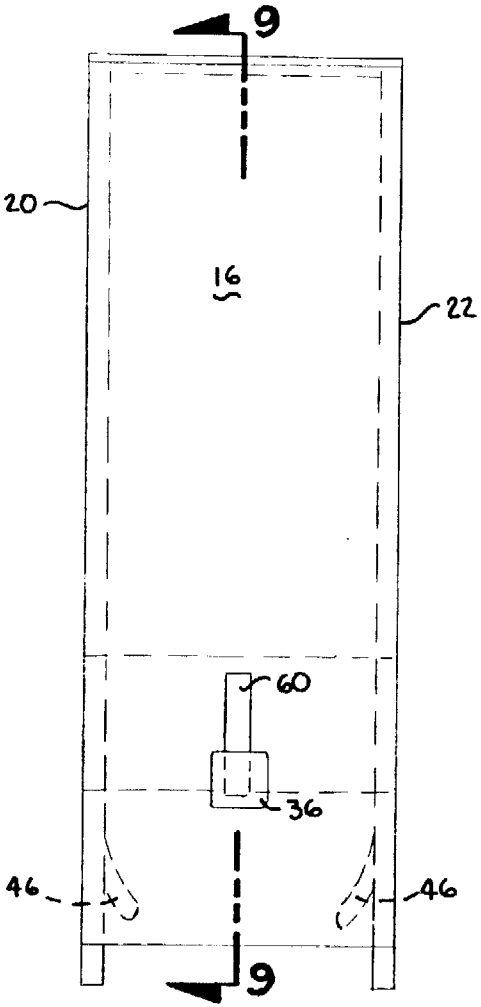
FIG. 8 is a front elevational view of another alternative embodiment of a roll dispenser and rack of our invention.

In still another embodiment of the invention as shown in FIGS. 8 and 9, a vertically disposed opening 60 is disposed in the from wall 16 of the magazine 12. Handle 36 is affixed to the paddle 34, and as the handle is actuated or pulled upwardly, and also outwardly, and then downwardly, the paddle is pivoted or rotated to an upper position and then back to a lower position, substantially as described above.

Figure 11:
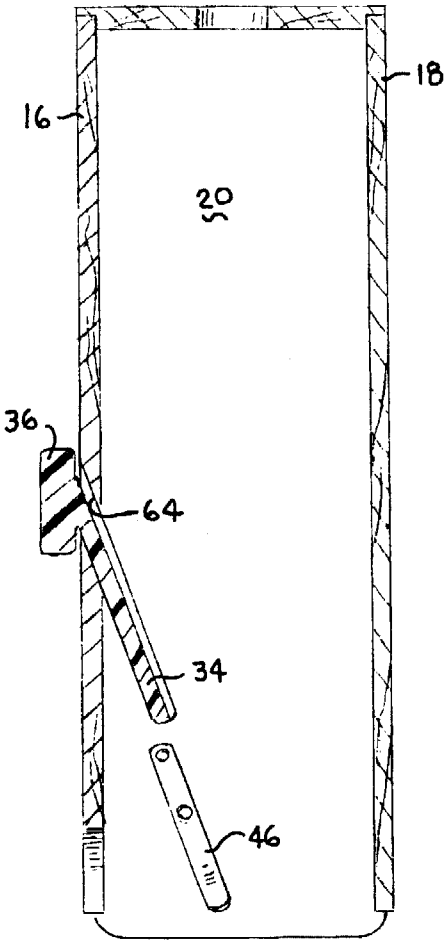
FIG. 11 is an elevational view in cross-section on line 11—11 of FIG. 10.
Figure 10:
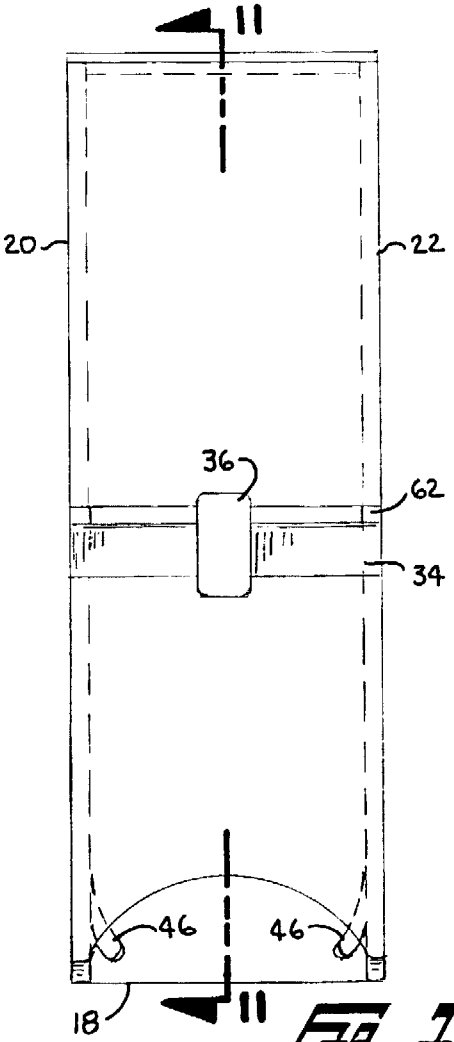
FIG. 10 is a front elevational view of still another alternative embodiment of a roll dispenser and rack of our invention.

Another embodiment of the invention is illustrated in FIGS. 10 and 11. The front wall 16 of the magazine 12 has a horizontal opening 62, which is cut diagonally relative to the plane of the front wall. Side walls 20 and 22 are provided with diagonal grooves or channels 64, which slope downwardly relative to the vertical plane of the side walls. Channels 64 abut opening 62 and have the same slope. It thus will be observed that the paddle 34, which is substantially planar, is inserted through the opening 62 and being slidably engagable in the channels or grooves 64, will slide diagonally into and out of the magazine. When the sliding paddle is raised to the upper-most position, a roll of tissue will drop into place, and as the paddle is lowered, the trailing marginal edge of the paddle will assist in forcing the roll onto the retaining means, substantially as described above.

It will be observed that the present invention provides a convenient, yet simple, dispenser and rack for storing and holding toilet tissue rolls. The device is aesthetically pleasing, of simple construction, and easy to install and operate.

It should be understood that the foregoing detailed description has been given for clearness of understanding only, and no unnecessary limitations should be understood therefrom, as modifications will be obvious to those skilled in the art.

What is claimed is:

1. A dispenser and rack for a roll of paper, plastic, or foil wound on a core, comprising:

(a) a substantially rectangular magazine for generally vertical disposition and having an open bottom, the inside width and length of said magazine being sufficient to accommodate one or more of said rolls;

(c) a paddle slidably mounted in said magazine and having a handle projecting outwardly from an opening in said magazine and free to be moved along said opening so as to slidably actuate said paddle between a lower-most position and an upper-most position, said paddle arranged (i) when in its lower-most position so as to obstruct said open bottom to prevent a roll from dropping from said magazine, and (ii) when slidably actuated to said upper-most position, to provide clearance to allow a roll to drop from said magazine through said open bottom; and (d) bracket means depending from said magazine below said open bottom and adapted to engage a core of a roll when said paddle is actuated to said upper-most position for revolvedly retaining said roll.

2. A dispenser and rack for said roll according to claim 1 wherein said magazine comprises (a) opposed, substantially parallel side walls, and (b) opposed, substantially parallel front wall and back wall, said back wall adapted for attachment to a supporting wall; said opening extending horizontally in said front wall; substantially opposed, parallel grooves in said side walls extending diagonally downwardly from said opening and adapted to receive said paddle for slidable movement in said grooves and across said opening; whereby said handle projecting from said opening can be moved to slide said paddle from said lower-most position to said upper-most position.

3. A dispenser and rack for a roll of paper, plastic, or foil wound on a core, comprising:

(a) a substantially rectangular magazine for generally vertical disposition and having an open bottom, the inside width and length of said magazine being sufficient to accommodate one or more of said rolls;

(c) a paddle slidably mounted in said magazine, said paddle having (i) an arcuate blade generally conforming to the arc defined by the circumference of a roll and (ii) a handle affixed to said blade and projecting outwardly from an opening in said magazine and free to be moved along said opening so as to pivot said blade about its central, longitudinal axis, said paddle arranged when in its lower-most position so that said blade obstructs said open bottom to prevent a roll from dropping from said magazine, and when pivoted provides clearance to allow a roll to drop from said magazine through said open bottom; and (d) bracket means depending from said magazine below said open bottom adapted to engage a core of a roll dropped from said magazine for revolvedly retaining said roll.

4. A dispenser and rack for said roll according to claim 3 wherein said magazine comprises a back wall for attachment to a supporting wall and an opposed, substantially parallel front wall, and said opening extending vertically in said front wall for a distance no greater than about one-half the circumference of said roll, whereby said handle projecting from said opening can be moved upwardly so as to pivot said blade about said roll in said magazine.

5. A dispenser and rack for said roll according to claim 4 wherein said opening is about one-fourth the circumference of said roll.

6. A dispenser and rack for said roll according to claim 3 wherein said magazine comprises substantially parallel, opposed side walls, and each of said side walls having an arcuate opening to accommodate the blade of said paddle whereby said handle projecting from at least one of said openings can be moved along said arcuate opening so as to pivot said blade.

7. A dispenser and rack for said roll according to claim 6 wherein said opening is of a generally semi-circular arc and having a diameter approximately equal to the diameter of said roll.

8. A dispenser and rack for said roll according to claim 6 wherein said arcuate opening is less than one-half the diameter of a roll, and each of said walls have an arcuate channel disposed on the inside surface of said walls, said arcuate channel coinciding with the arcuate opening so as to receive the blade of said paddle when pivoted for slidable movement in said channel.

9. A dispenser and rack for a roll of paper, plastic, or foil wound on a core, comprising:

(a) a substantially rectangular magazine for generally vertical disposition and having substantially parallel side walls and an open bottom, the inside width and length of said magazine being sufficient to accommodate one or more of said rolls;

(b) each of said side walls having an opening of a generally semi-circular arc disposed adjacent the bottom edge of said side walls, said opening having a diameter approximately equal to the diameter of said roll and disposed so that the chord subtending said arc is substantially vertical;

(c) a paddle extending between said side walls and mounted in said openings, said paddle having a circumference less than the circumference of said openings so as to be free to be rotated about its central, longitudinal axis in said openings, said paddle arranged when in its lower-most position so as to obstruct said open bottom to prevent a roll from dropping from said magazine; and (d) bracket means depending downwardly from each of said side walls adaptable to engage a core of a roll for revolvedly retaining said roll.

10. A dispenser and rack for said roll according to claim 9 wherein said paddle has an arcuate blade generally conforming to said semi-circular arc, and a handle affixed to said blade and projecting outwardly from said opening and free to be moved along said opening so as to pivot said blade about its central longitudinal axis.

11. A dispenser and rack for said roll according to claim 10 wherein said blade has a cross-sectional segment about one-half of the segment length of said arc.

12. A dispenser and rack for said roll according to claim 10 wherein said bracket means is resilient and biased inwardly from said side walls whereby pressure applied by a roll deflects the bracket means laterally.

13. A dispenser and rack for said roll according to claim 10 wherein said side walls extend downwardly beyond said open bottom, and said bracket means is affixed to said extended part of said side walls.

14. A dispenser and rack for said roll according to claim 10 wherein said blade having horizontally disposed marginal edges and at least one of said marginal edges is tapered.

* * * * *